US010494073B1

(12) United States Patent
Hundertmark

(10) Patent No.: US 10,494,073 B1
(45) Date of Patent: Dec. 3, 2019

(54) STEERING APPARATUS FOR OUTBOARD MOTOR

(71) Applicant: Marine Tech Products, Inc., Vadnais Heights, MN (US)

(72) Inventor: James M. Hundertmark, Fond du Lac, WI (US)

(73) Assignee: Marine Tech Products, Inc., Vadnais Heights, MN (US)

( * ) Notice: Subject to any disclaimer, the term of this patent is extended or adjusted under 35 U.S.C. 154(b) by 0 days.

(21) Appl. No.: 16/037,122

(22) Filed: Jul. 17, 2018

(51) Int. Cl.

| | |
|---|---|
| ***B63H 5/125*** | (2006.01) |
| ***B63H 20/08*** | (2006.01) |
| ***B63H 20/12*** | (2006.01) |
| ***B63H 20/10*** | (2006.01) |
| *B63H 25/42* | (2006.01) |

(52) U.S. Cl.
CPC ..... *B63H 20/12* (2013.01); *B63H 20/10* (2013.01); *B63H 25/42* (2013.01); *B63H 2020/103* (2013.01)

(58) Field of Classification Search
CPC ..... B63H 20/08; B63H 20/10; B63H 20/12; B63H 25/42; B63H 2020/08; B63H 2020/10; B63H 2020/103
USPC ..... 440/53, 55, 61 R, 61 S, 61 A, 61, 610, 440/61 D, 61 E, 61 F, 61 G, 62, 63
See application file for complete search history.

(56) References Cited

U.S. PATENT DOCUMENTS

| | | | | |
|---|---|---|---|---|
| 4,227,481 A * | 10/1980 | Cox | B63H 21/265 114/144 R |
| 5,259,331 A | 11/1993 | Hagan | |
| 6,077,136 A * | 6/2000 | Arai | B63H 20/00 440/86 |
| 9,669,914 B1 * | 6/2017 | Hundertmark | B63H 20/12 |
| 9,889,913 B1 | 2/2018 | Hundertmark | |

* cited by examiner

*Primary Examiner* — Daniel V Venne
(74) *Attorney, Agent, or Firm* — Howson & Howson LLP

(57) ABSTRACT

When a cable-actuated power steering system is used with an outboard motor tiltably supported on a motor mounting pod of a pontoon boat, interference between a valve actuator housing on the end of a cylinder ram of a hydraulic cylinder unit and a side wall of pod is avoided by offsetting the cylinder toward one side wall of the pod so that the actuator housing can move through its full range without interfering with the opposite side wall, and connecting the cable-activated steering rod to a lever on top of the actuator through an L-shaped secondary link that has a first part extending laterally from an end of the steering rod and a second part extending from the first part to the lever in a direction opposite to the direction in which the cylinder ram extends from the cylinder.

7 Claims, 4 Drawing Sheets

Fig. 4A
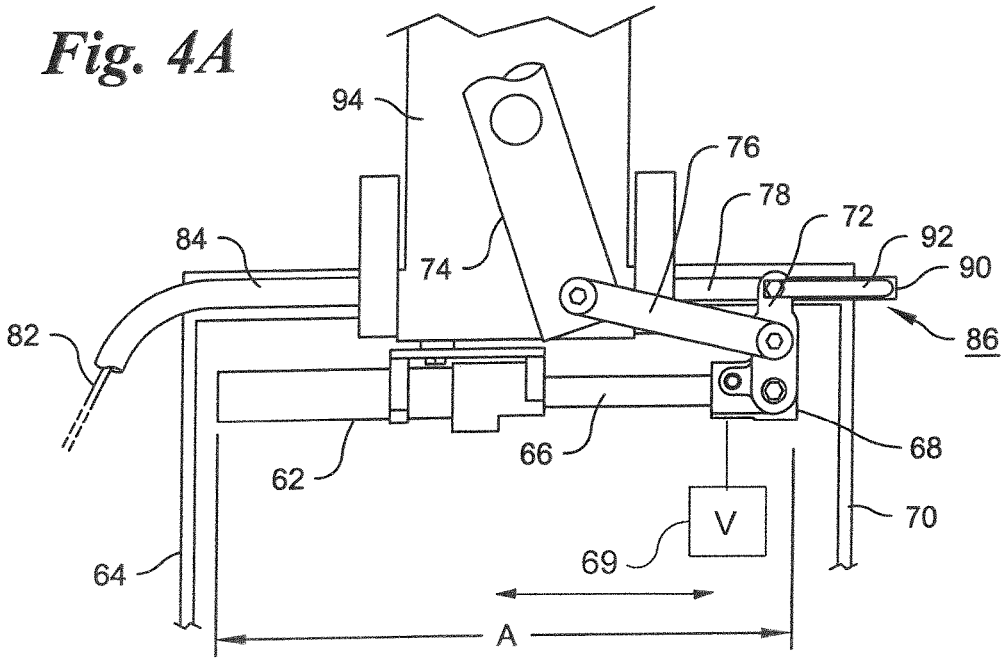
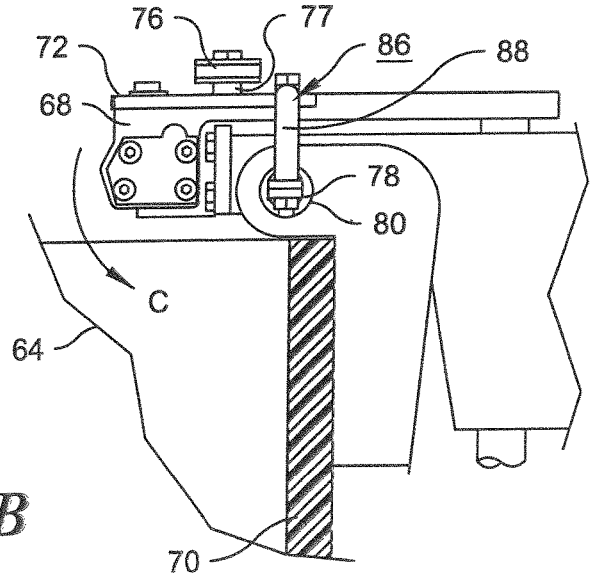
Fig. 4B

STEERING APPARATUS FOR OUTBOARD MOTOR

FIELD OF THE INVENTION

This invention relates to marine propulsion, and particularly to a cable-activated hydraulic power steering apparatus for steering an outboard motor on a boat, such as a pontoon boat, having limited apace for extension of the cylinder ram of the power steering cylinder unit.

BACKGROUND OF THE INVENTION

Power steering of an outboard motor can be carried out by means of a cable-activated power steering apparatus in which the outboard motor is connected though a linkage to the actuator housing of a hydraulic cylinder unit, and rotated about a vertical pivot axis by operation of the hydraulic cylinder unit. The hydraulic cylinder unit is supplied by a pump with hydraulic fluid under pressure, and the rate and direction of flow of the hydraulic fluid are controlled by valves inside the actuator housing, which are in turn operated by a valve actuator in the actuator housing and controlled remotely by a helm through a cable that slides longitudinally in a surrounding sheath. The cable is connected to one end of a steering rod (also commonly referred to as a "cable ram") that is slidable in a tube mounted in fixed relation to a bracket by which the outboard motor is supported on a transom. The other end of the steering rod is connected to a lever on the actuator housing for controlling the valves.

The hydraulic cylinder unit operates as a "follow-up" mechanism, in which the movement of the actuator housing and cylinder ram follows the movement of the cable. Thus, in the case where the hydraulic cylinder unit is arranged so that the actuator housing and cylinder ram extend from the cylinder in the port direction, whenever the pilot rotates the helm clockwise to turn to starboard, the cable pushes the actuator lever and the actuator operates the valves in such a way as to extend the actuator housing and cylinder ram. On the other hand, whenever the pilot rotates the helm counterclockwise to turn to port, the cable pulls the actuator lever, and the actuator operates the valves in such a way as to retract the actuator housing and cylinder ram. Within a range of operation, the actuator housing and cylinder ram continue to move as long as the movement of the cable continues, and stop when movement of the cable stops and the lever on the actuator housing assumes a neutral position. The rate of movement of the actuator housing and cylinder ram is also dependent on the degree of opening of the valves, which is in turn dependent on the rate of movement of the cable as controlled by rotation of the helm.

An example of a cable-activated power steering apparatus is described in detail in U.S. Pat. No. 9,669,914, granted on Jun. 6, 2017. The entire disclosure of U.S. Pat. No. 9,669,914 is here incorporated by reference.

In most outboard-propelled boats, the outboard motor is supported on a transom that is a part of the boat's hull. The motor is mounted both for pivoting about a vertical axis for steering, and for tilting about a horizontal axis, not only for trim adjustment, but also so that the propeller can be raised to a level above the bottom of the hull for launching from, and landing on, a beach and for transport of the boat on a trailer. Most outboard engine mounts allow tilting through a range of 70° or more.

In the case of an outboard motor-propelled pontoon boat, the outboard motor is ordinarily supported on a "pod," a structure located between the pontoons and supported from a deck extending from one pontoon to the other. A typical pod for mounting an outboard motor on a pontoon boat comprises a pair of laterally spaced side walls that diverge from each other, proceeding in the aft direction, and a transom extending from one side wall to the other at the aft ends thereof.

A typical power steering unit for a pontoon boat utilizes a hydraulic cylinder that moves on a rod extending between two mounting brackets. A link connected from the cylinder to a steering arm on the motor causes the motor to pivot about a substantially vertical steering axis as the hydraulic cylinder moves on the rod. When the engine is tilted, the cylinder and brackets move into a space between the side walls of the motor-supporting pod.

A cable-activated power steering apparatus can be utilized in a pontoon boat, but the spacing of the side walls of a motor-supporting pod is typically insufficient to permit tilting of the motor. A cable-actuated steering rod (i.e., a "cable ram") is connected to a valve actuator on the actuator housing at the end of the cylinder ram. The steering rod typically extends through a "tilt tube" that is centered in relation to the motor and therefore also centered in relation to the pod. Because of the central location of the tilt tube, the steering rod moves through a range that extends past one of the side walls of pod. Consequently, the actuator housing at the outer end of the cylinder ram, which is connected to the end of the steering rod, will also extend past the side wall of the pod when the cylinder ram is fully extended. On tilting, if the cylinder ram is extended, the actuator housing can collide with a side wall of the pod. To remedy this problem, a common practice is to remove part of the side wall of the pod to provide clearance for the actuator housing and cylinder ram. However, removal of material degrades the strength of the pod.

SUMMARY OF THE INVENTION

This invention addresses the above-described problem of interference between the actuator housing and the side wall of the pod, allowing a cable-activated power steering apparatus to be used in a pontoon boat, and the motor to be tilted though its full range, without the need to modify the pod.

The cable-actuated power steering system in accordance with the invention is mounted on a transom of a pod having side walls, e.g., a pod located between a pair of pontoons of a pontoon boat. The outboard motor that propels the pontoon boat is pivotable about a substantially vertical steering axis and tiltable about a substantially horizontal tilting axis.

The power steering system comprises a hydraulic cylinder unit having a cylinder, a ram, an actuator housing, and actuator in the actuator housing and a valve mechanism controlled by the actuator, and preferably located, along with the actuator, within the actuator housing. The cylinder ram extends from the cylinder along the cylinder axis, which is substantially parallel to the horizontal tilting axis, and the cylinder ram is extensible and retractable in the direction of the cylinder axis.

The cylinder unit has first and second opposite ends, one being the end of actuator housing and the other being the end of the cylinder. The valve mechanism, which is preferably located within the actuator housing, is configured to control the flow of hydraulic fluid to and from the hydraulic cylinder for effecting extension and retraction of the cylinder ram. A steering link connected to the actuator housing is connectible to a steering arm of the pivotable outboard motor to effect pivoting movement of the motor about a substantially vertical steering axis. An actuator arm mounted on the actuator housing is movable relative to the actuator housing and connected to the valve mechanism so that movement of the actuator arm relative to the actuator housing controls the valve mechanism to effect extension and retraction of the cylinder ram.

A steering rod is mounted for movement in a direction substantially parallel to the direction of the tilting axis. This steering rod has a first end connected to the actuator arm to effect movement of the actuator arm relative to the actuator housing. A steering cable is connectible to a steering helm and connected to the steering rod at a location adjacent a second end of the steering rod opposite from the first end thereof. The steering cable is arranged to effect movement of the actuator arm in response to operation of the steering helm.

The motor is pivotable for tilting about the tilting axis through a range such that at least a part of the actuator housing is located directly between portions of the side walls of the pod. The connection of the steering rod to the actuator arm is through a connecting link that includes a first link part that extends laterally from the first end of the steering rod and a second link part that extends from the first link part to the actuator arm. This arrangement allows the actuator housing and cylinder ram to remain in the space between the side walls of the pod when the cylinder unit is fully extended. Therefore, when the outboard motor is tilted, there is no interference between the actuator housing and a side wall of the pod.

In a preferred embodiment, the movement of the actuator housing is limited to a region such that, when the outboard motor is tilted, the actuator housing is positioned between the side walls of the pod.

The actuator housing can be mounted at either of the first and second opposite ends of the hydraulic cylinder unit, but is preferably located on the end of the cylinder ram remote from the cylinder. In this case the cylinder does not move laterally relative to the pod. In an alternative embodiment, in which the actuator housing is mounted on the end of the cylinder remote from the location at which the cylinder ram emerges from the cylinder, the cylinder can move laterally while the ram is mounted so that it does not move laterally.

The steering rod can be mounted for movement through a limited range in a direction substantially parallel to the direction of the tilting axis, and is preferably aligned with the tilting axis. In a preferred embodiment, the steering rod extends through, and is movable longitudinally in, a tube extending along the tilting axis.

The actuator arm is preferably located on an upward-facing side of the actuator housing and movable relative to the actuator housing about a pivot axis extending upward from the upward-facing side of the actuator housing.

BRIEF DESCRIPTION OF THE DRAWINGS

FIG. 4A is a schematic top plan view of a cable operated power steering system in accordance with the invention; and FIG. 4B is right-side elevational view of the steering system of FIG. 3A showing the transom of the pod in cross-section.

DETAILED DESCRIPTION OF THE PREFERRED EMBODIMENTS

Figure 1:
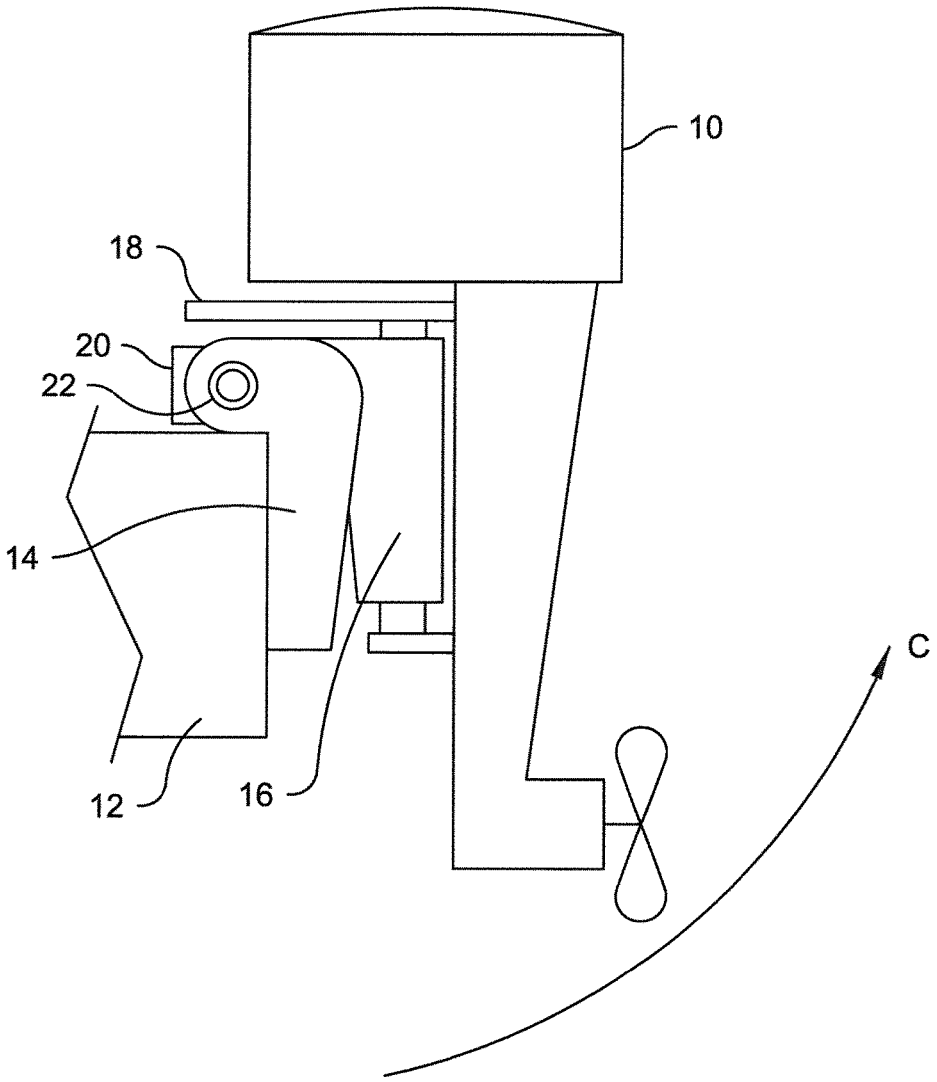
Fig. 1 (Prior Art)
FIG. 1 is a schematic side elevational view showing an outboard motor mounted on an engine mounting pod and illustrating the direction in which the outboard motor is tilted.

As shown in FIG. 1, an outboard motor 10 is attached to the transom of a pontoon boat engine mounting pod 12 by clamp brackets 14. The motor is pivoted about a substantially vertical axis for steering in a swivel bracket 16, and steered by a steering arm 18 operated by a hydraulic mechanism (not shown in FIG. 1) supported by brackets 14. The outboard motor 10 is pivotable for tilting in a direction indicated by arrow C about a substantially horizontal pivot axis, which is also the axis of a "tilt tube" 22. Typically the motor can be tilted from its normal operating position as shown in FIG. 1 though a range of at least 70°. In most cases the tilt angle is between 70° and 90°.

Figure 2A:
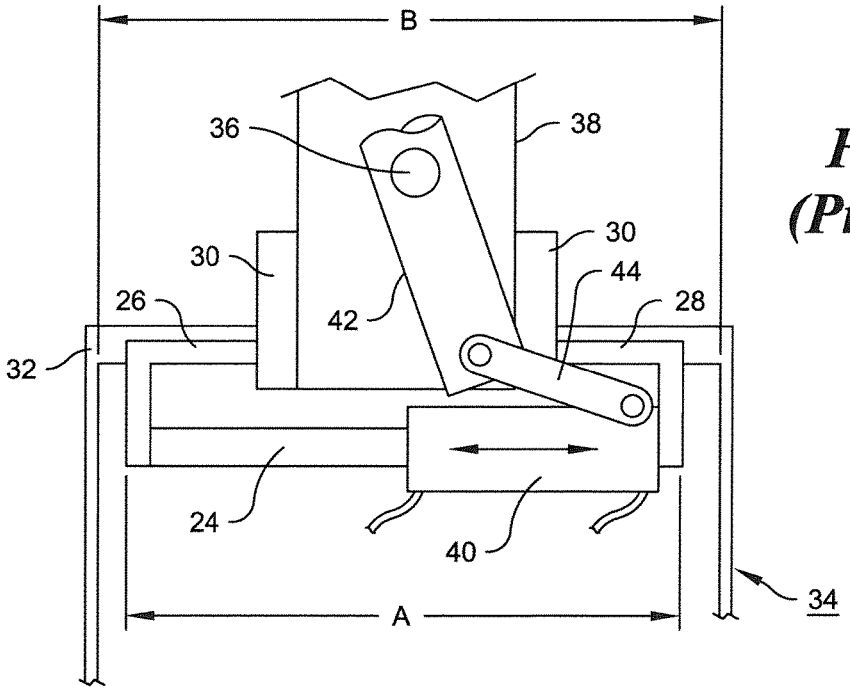
Fig. 2A (Prior Art)
FIG. 2A is a schematic top plan view of a conventional hydraulic steering system on a pontoon boat, the system having a cylinder that moves on a rod supported between two mounting brackets.
Figure 2B:
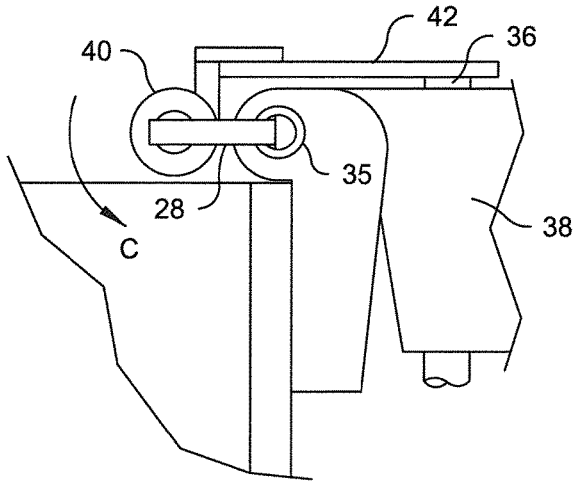
Fig. 2B (Prior Art)
FIG. 2B is a right side elevational view of the steering system of FIG. 2A, showing the direction of movement of the cylinder when the engine is tilted.

In a typical pontoon boat, the outboard motor is steered by a cylinder that travels on a rod in response to the pumping of hydraulic fluid into and out of the cylinder by a control (not shown). The hydraulic fluid fills spaces on opposite sides of an internal piston (not shown) fixed to the rod. FIG. 2A shows a such a rod 24 extending between brackets 26 and 28 and supported by those brackets from clamp brackets 30 on the transom 32 of a pod 34. The brackets are mounted for rotation about a horizontal tilting axis, which is the axis of a tilt tube 35, shown in FIG. 2B. The motor (not shown in FIGS. 2A and 2B) is supported on a shaft 36. The shaft is rotatable in a swivel bracket 38 for steering about a vertical pivot axis. The motor is connected to the traveling cylinder 40 though a steering arm 42 and a link 44.

In FIG. 2A, the steering arm 42 is shown in a position for a full right turn, and the cylinder 40 is at the limit of its travel toward bracket 28. The brackets extend through a distance A, which is less than the spacing B between the side walls of the pod 34. Thus, when the motor is tilted about the tilting axis in the direction indicated by arrow C in FIG. 2B, the rod 24, brackets 26 and 28, and the cylinder 40, can move into the space between the side walls 34 of the pod regardless of the position of the cylinder.

In the case of a cable-activated steering mechanism, steering is controlled by a hydraulic cylinder unit comprising a cylinder, a cylinder ram and an actuator housing that, in most cases, is supported on the end of the cylinder ram and travels with the cylinder ram while the cylinder is fixed to a swivel bracket that support the motor from a transom. (As mentioned previously an alternative, in which the cylinder ram is fixed to the swivel bracket, and the actuator housing and cylinder move relative to the swivel bracket, is also possible.) This type of steering mechanism is used on boats having conventional hulls, but can also be used on pontoon boats if the engine mounting pod is appropriately modified. The steering mechanism is depicted in FIGS. 3A and 3B.

Figure 3A:
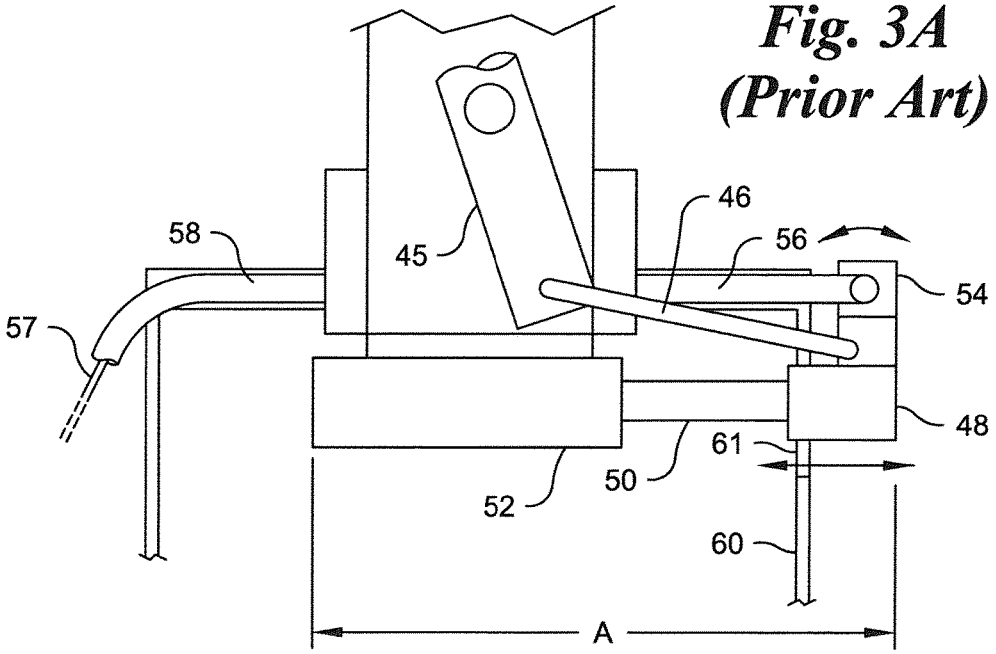
Fig. 3A (Prior Art)
FIG. 3A is a schematic top plan view of a cable operated power steering system of the kind ordinarily used on a conventional outboard-propelled boat, but installed on a motor-supporting pod on a pontoon boat.
Figure 3B:
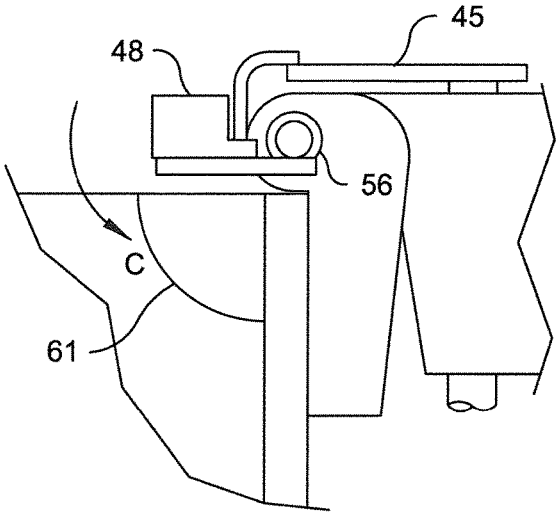
Fig. 3B (Prior Art)
FIG. 3B is a right-side elevational view of the steering system of FIG. 3A.

In FIGS. 3A and 3B, the outboard motor (not shown) is supported on a swivel bracket. The outboard motor is steered by a steering arm 45 connected through a link 46 to an actuator housing 48 mounted on an end of a cylinder ram 50 extending from a hydraulic cylinder 52. A valve mechanism within the actuator housing 48 controls the flow of hydraulic fluid supplied by a pump (not shown) to control the rate and direction of movement of the actuator housing. The valve mechanism is in turn controlled by an arm 54 mounted on the actuator housing 48. Arm 54 is pivoted on the actuator housing for movement about a vertical axis. This arm 54 is connected to, and operated by, a steering rod 56, which is guided for longitudinal movement and controlled from a remote steering helm (not shown) by a cable 57 that is movable in a cable sheath 58. The movement of the cylinder ram 50 and the actuator housing follows the movement of the steering rod 56. Relatively little force is required to move the steering rod because the hydraulic cylinder unit (comprising cylinder 52, cylinder ram 50 and actuator housing 48) applies the force that steers the outboard motor. The steering mechanism of FIGS. 3A and 3B is substantially as described in U.S. Pat. No. 9,669,914, granted on Jun. 6, 2017.

In most pontoon boats, the height of the side walls of the engine mounting pod is the same as the height of the transom on the pod. Accordingly if the steering mechanism of FIGS. 3A and 3B is utilized on a pontoon boat, a part of the side wall of the pod adjacent the actuator housing needs to be removed to provide a clearance in order to avoid collision, when the outboard motor is tilted, between the actuator housing and the adjacent side wall, e.g., side wall 60. Here, a part of the side wall 60 is removed to provide a clearance 61 for the actuator housing 48. As mentioned above, removal of a part of the side wall can degrade the strength of the pod.

The steering system in accordance with the invention, as shown in FIGS. 4A and 4B, utilizes a hydraulic cylinder unit comprising a cylinder 62, a cylinder ram 66, an actuator housing 68, and valve mechanism 69, shown schematically and preferably located withing the actuator housing 68 and controlled by movement of a pivoted actuator arm 72, to effect extension and retraction of the cylinder ram relative to the cylinder. The cylinder 62 is offset from a central location between the side walls of the pod toward side wall 64 of the pod. By virtue of this offset relationship, even when the cylinder ram 66 and actuator housing 68 are fully extended, the actuator housing 68 does not reach a location above the opposite side wall 70.

Because the cylinder unit is offset toward the starboard side, the pivoted actuator arm 72 is located on the top of the actuator housing 68 to avoid collision with the adjacent clamp bracket when the cylinder ram is retracted. The steering arm 74 is connected to the actuator housing 68 by a link 76 and a boss 77 that is fixed to, and extends upward from, the actuator housing 68 though an opening (not shown) in the actuator arm 72. The opening is larger than the boss 77, and provides a clearance that allows a limited degree of pivoting movement of the actuator arm 72 on the actuator housing.

A cable ram 78 is slidable in a tilt tube 80 and is controlled by a remote steering helm (not shown) by a cable 82 that is movable in a cable sheath 84. The cable ram 78 is connected to the actuator arm 72 though an L-shaped secondary link 86 that has a first part 88 that extends upward from the end 90 of the cable ram and a second part 92 that extends parallel to the cable ram but in a direction opposite to the direction in which the cable ram extends from the tilt tube 80. The tilt tube 80 can be in its usual relationship to the swivel bracket 94, i.e., in a central location relative to the transom, and the cable ram 78, the actuator housing 68, and the cylinder ram 66, are movable through a range such that the outboard motor can be steered from a full right turn position to a full left turn position without having the actuator housing 68 reach a position such that it can collide with the side wall 70 of the pod if the engine is tilted. As is apparent from FIGS. 4A and 4B, even if the engine is tilted by 90°, the secondary link will not collide with the side wall 70 of the pod. Thus it is unnecessary to remove a part of the side wall 70.

In a modified version of the steering system, the cylinder ram can be fixed to the pod while the cylinder is movable and carries the actuator housing. This and various other modifications can be made to the apparatus described above without departing from the scope of the invention, which is defined by the following claims.

What is claimed is:

1. A cable-actuated power steering system for a boat propelled by an outboard motor mounted on a transom of a pod having side walls, said outboard motor being pivotable about a substantially vertical steering axis and tiltable about a substantially horizontal tilting axis, the power steering system comprising:

a hydraulic cylinder unit comprising a cylinder, a cylinder ram, an actuator housing, an actuator in said actuator housing and a valve mechanism controlled by said actuator, the cylinder ram extending from an interior of the cylinder to the exterior thereof along a cylinder axis substantially parallel to said tilting axis, the cylinder ram being extensible and retractable from said cylinder in the direction of said cylinder axis, the combination of said cylinder and said cylinder ram having first and second opposite ends, one of said first and second opposite ends being an end of the cylinder ram and the other of said first and second opposite ends being an end of the cylinder, said actuator housing being mounted at one of said first and second opposite ends, and said valve mechanism being configured to control the flow of hydraulic fluid to and from the hydraulic cylinder for effecting extension and retraction of said cylinder ram;

a steering link connected to the actuator housing and connectible to a steering arm on said pivotable outboard motor to effect pivoting movement of said outboard motor about a substantially vertical steering axis;

an actuator arm mounted on the actuator housing, the actuator arm being movable relative to the actuator housing and connected to said valve mechanism whereby movement of the actuator arm relative to the actuator housing controls the valve mechanism to effect extension and retraction of the actuator housing and cylinder ram;

a steering rod mounted for movement in a direction substantially parallel to the direction of said tilting axis, said steering rod having a first end connected to said actuator arm to effect said movement of the actuator arm relative to the actuator housing; and a steering cable connectible to a steering helm and connected to said steering rod at a location adjacent a second end of said steering rod opposite from said first end thereof, said steering cable being arranged to effect said movement of the actuator arm in response to operation of said steering helm;

wherein said motor is pivotable for tilting about said tilting axis through a range such that at least a part of said actuator housing is located directly between portions of the side walls of said pod; and wherein the connection of said steering rod to the actuator arm through a connecting link includes a first link part that extends laterally from said first end of the steering rod and a second link part that extends from said first link part to said actuator arm in a direction opposite to the direction in which actuator housing moves as said cylinder ram extends from said cylinder.

2. The cable-actuated power steering system of claim 1, wherein said valve mechanism is located in said actuator housing.

3. The cable-actuated power steering system of claim 1, including said pod and wherein the movement of said actuator housing is limited to a region such that, when the outboard motor is tilted, the actuator housing is positioned between said side walls of the pod.

4. The cable-actuated power steering system of claim 1, including said pod and wherein said actuator housing is mounted at said end of the cylinder ram.

5. The cable-actuated power steering system of claim 1, in which said steering rod is mounted for movement through a limited range in said direction substantially parallel to the direction of said tilting axis.

6. The cable-actuated power steering system of claim 1, in which said actuator housing has an upward-facing side and in which said actuator arm is located on said upward-facing side of the actuator housing and movable relative to the actuator housing about a pivot axis extending upward from the upward-facing side of the actuator housing.

7. The cable-actuated power steering system of claim 1, in which said steering rod extends through, and is movable longitudinally in, a tube extending along said tilting axis.

* * * * *